US005984025A

United States Patent [19]

Phillips

[11] Patent Number: 5,984,025

[45] Date of Patent: Nov. 16, 1999

[54] DRILL PIPE TONG RETAINING APPARATUS

[76] Inventor: Jerry Phillips, 11653 Highway 105, Melville, La. 71353

[21] Appl. No.: 08/947,185

[22] Filed: Oct. 8, 1997

[51] Int. Cl.[6] ..... E21B 19/16

[52] U.S. Cl. ..... 175/85; 175/90; 166/77.51; 166/85.5; 166/96.1

[58] Field of Search ..... 175/57, 85, 90; 166/77.51, 85.1, 85.5, 96.1

[56] References Cited

U.S. PATENT DOCUMENTS

| | | | |
|---|---|---|---|
| 1,644,470 | 10/1927 | Greve . | |
| 3,288,000 | 11/1966 | Foster . | |
| 3,760,658 | 9/1973 | Guier . | |
| 3,780,815 | 12/1973 | Barron et al. | 166/77.5 X |

OTHER PUBLICATIONS

Disclosure Document No. 417339 filed Apr. 7, 1997 titled Drill Pipe Tong Retaining Apparatus.

*Primary Examiner*—Roger Schoeppel
*Attorney, Agent, or Firm*—Jesse D. Lambert

[57] ABSTRACT

Apparatus for positively retaining drill pipe tongs at a desired position horizontally displaced from a center of a rig floor. The apparatus includes a latch connected to a removable stand which places the latch at a desired height above the rig floor and a desired horizontal displacement from the center of the rig floor. The latch includes a jaw having an elongated channel. A retainer arm is rotatably attached to the jaw and is spring biased between a first closed position, where the retainer arm obstructs the channel, and a second open position, where the retainer arm does not obstruct the channel. A catch piece, including a generally vertically disposed tubular member sized to fit in the retainer arm, is attached to a set of tongs. The tongs are pushed away from the center of the rig floor, and the catch piece is guided into the channel of the jaw, displacing the retainer arm from the first closed position and permitting the catch piece to move toward the terminus of the channel. Further movement of the catch piece past the retainer arm permits the catch piece to clear the retainer arm and the retainer arm to move into a second closed position, trapping the catch piece in the channel, thus retaining the drill pipe tongs at a desired position horizontally displaced from the center of the rig floor.

11 Claims, 5 Drawing Sheets

DRILL PIPE TONG RETAINING APPARATUS

BACKGROUND OF THE INVENTION

1. Field of the Invention

This invention relates to apparatus for positioning rig equipment in a desired position on a drilling rig floor. With further specificity, this invention relates to apparatus designed to be removably mounted on a drilling rig floor, which provides means for holding drill pipe tongs at a desired horizontal displacement from the center of the rig floor, by latch means that accept and releasably hold a catch piece affixed to the drill pipe tongs.

2. Description of the Related Art

Drilling rigs for drilling oil and gas wells usually employ at least two sets of drill pipe "tongs", or large wrenches, to make up and break out the threaded connections which join individual joints of pipe into long "strings". These tongs are suspended at a desired height above the rig floor by a cable which passes over a pulley mounted near the top of the derrick or mast of the rig. The end of the cable opposite the tongs connects to a counterweight, adjusted to be nearly the same weight as the drill pipe tongs, so that the tongs may be easily raised and lowered to a desired height. The pulley is generally placed nearly overhead the center of the rig floor, and the weight of the tongs creates a pendulum effect tending to always swing the tongs toward the center of the rig floor. As the tongs are usually being used on connections on drill pipe or other drill string components that are held in slips in the center of the rig floor, the tendency of the tongs to swing toward the center of the rig floor is often advantageous. However, for a number of tasks during the drilling of a well, it is desirable to pull the tongs away from the center of the rig floor, so that free and uninhibited access to the central rig floor area can be had. A problem arises in securing the tongs at a desired horizontal displacement away from the center of the rig floor, while permitting easy release of the tongs when desired.

Past methods generally involved tying the tongs off to stanchions or structural members of the rig, often with a knotted rope or a chain draped through a hook welded to the tongs. This method presents a number of drawbacks. First, the rig worker must push the tongs to the desired tie off point, generally using both hands, then remove one hand from the tongs in order to lift and place the rope or chain through the hook. The process must be reversed in order to free the tongs. The necessary removal of one hand from the tongs to place or remove the rope or chain greatly decreases the rig worker's control over the tongs.

With increasing emphasis on safety and efficiency in rig operations, the old method of tying off tongs has become increasingly unacceptable. Often, tongs would come loose from their ties and swing toward the center of the rig floor. The great weight and inertia of the free-swinging tongs striking rig workers in their backs or other parts of the body, and having parts of their body, especially fingers and hands, "sandwiched" between a swinging tong and a section of drill pipe, has caused many injuries. Due to the inconvenience in tying off tongs away from the well bore, rig workers would often simply let the tongs hang free, and push them just far enough out of the way to perform their desired tasks (without tying them off), while always keeping a look out for the tongs tending to swing back toward the center of the rig floor and possibly strike them.

The related art shows no apparatus, readily adapted to existing rig equipment, which provides a convenient, positive retaining means for holding tongs at a desired horizontal displacement away from the center of the rig floor, while permitting easy release when desired to use the tongs at the center of the rig floor.

It is therefore an object of the present invention to provide an apparatus for positive retention of rig tongs and other rig equipment at a desired horizontal displacement away from the center of the rig floor. It is a further object of the present invention to provide apparatus which permits engagement and retention of the tongs by simply guiding a catch piece connected to the tongs into a latch, the latch comprising a jaw and retainer arm, so that the catch piece is caught behind the retainer arm and positively retained. Yet another object is to provide apparatus adapted to easy installation on a drilling rig and incorporation with existing equipment, and that is easily removed if not needed or when the drilling rig is being moved from one location to another. Still further objects are to provide apparatus that permits easy height and horizontal position adjustments, that requires only simple modifications to existing rig equipment, that greatly increases rig safety by holding tongs positively away from the center of the rig floor, and that has such ease of use that rig workers will voluntarily and willingly use it. Finally, an object of the present invention is to provide an apparatus that is simple and inexpensive to fabricate and install on virtually any type of drilling rig.

DESCRIPTION OF THE DRAWING FIGURES

DESCRIPTION OF THE PREFERRED EMBODIMENT

Although the present invention may lend itself to several embodiments, with respect to FIGS. 1 through 6, one embodiment is herein described. It is understood that although the following description refers at times to "drilling rigs", that the invention is equally applicable to those rigs commonly known as "workover rigs" or the like; and that although the description references drill pipe "tongs", the invention is equally applicable to other rig equipment, such as power tongs, casing tongs, tubing tongs, and the like.

Figure 1:
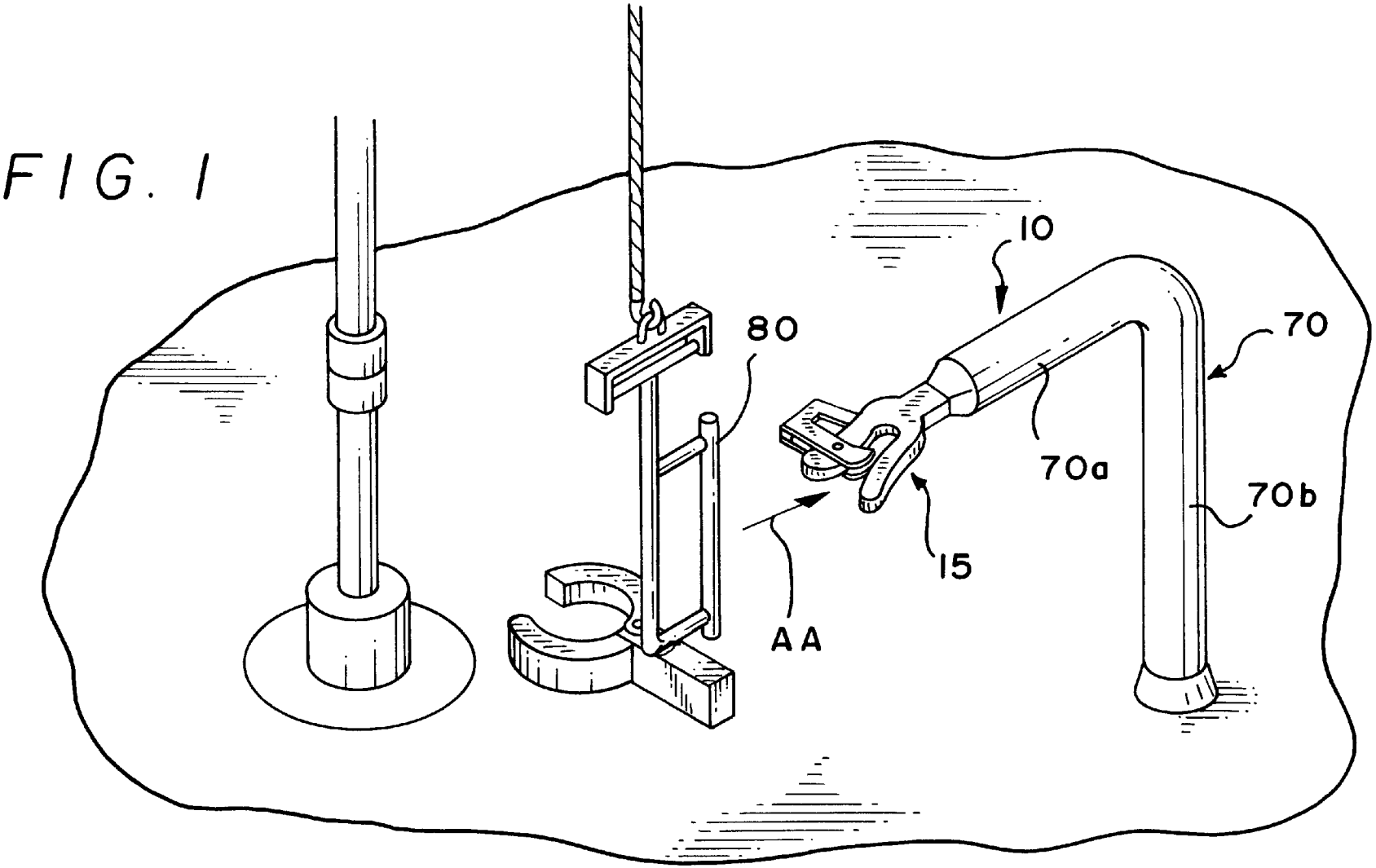
FIG. 1 is a perspective view of one set of tongs with a catch piece attached, a stand mounted on the rig floor, a latch of the present invention mounted on the stand, and a set of tongs in place for moving into latched position.

FIG. 1 is a simplified view of a rig floor with the apparatus 10 of the present invention in place on the rig floor and a catch piece 80 mounted on one set of drill pipe tongs. A stand 70 is mounted on the rig floor, and a latch 15 is mounted at the end of horizontal section 70*a* of stand 70, as will be hereinafter described. An arrow AA illustrates the path of travel of catch piece 80 into latch 15.

Figure 2:
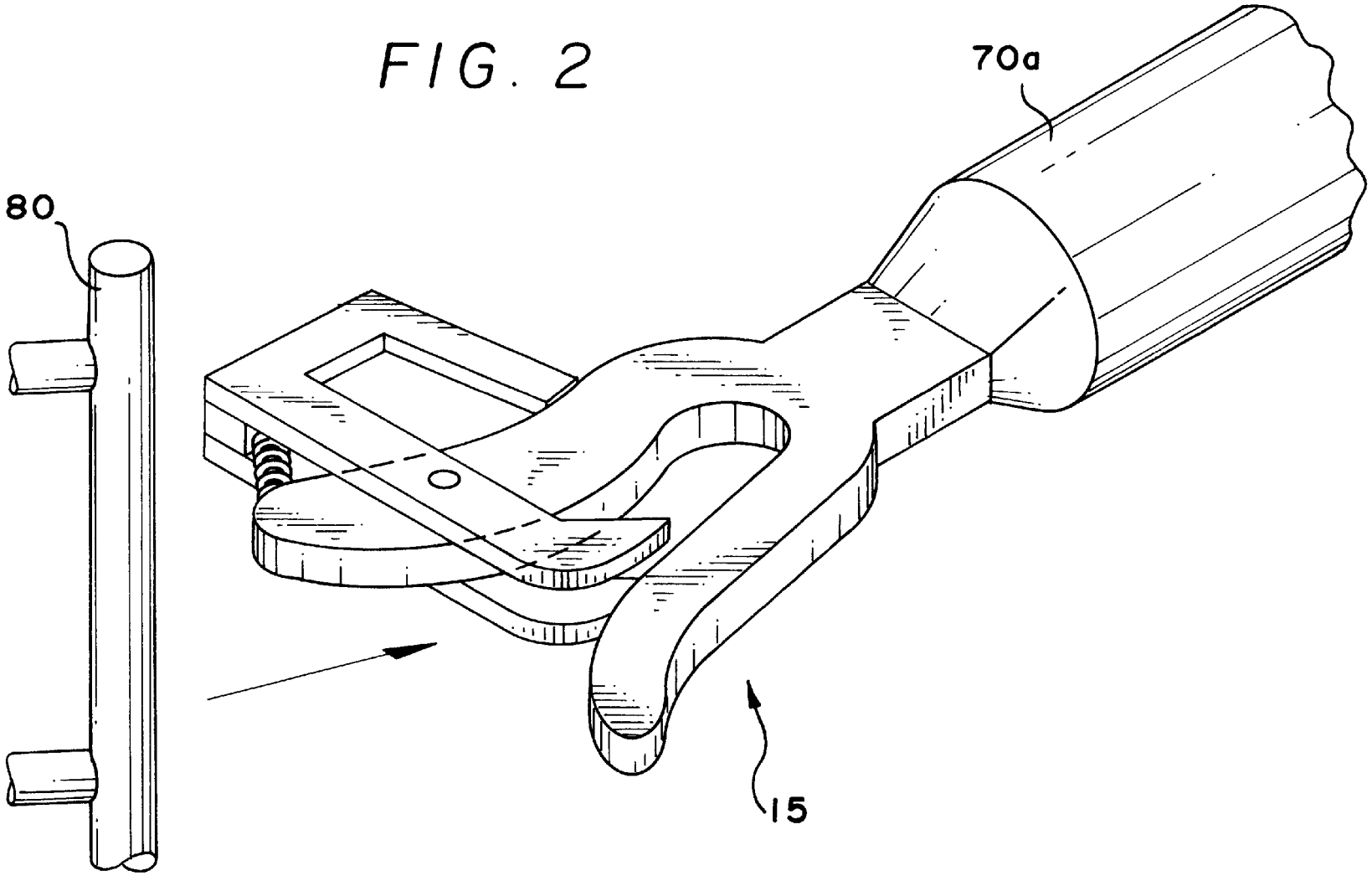
FIG. 2 is a more detailed perspective view of the present invention.

FIG. 2 is a perspective view of latch 15 mounted on horizontal section 70*a* of stand 70, with catch piece 80 in position for engagement therein.

Figure 3:
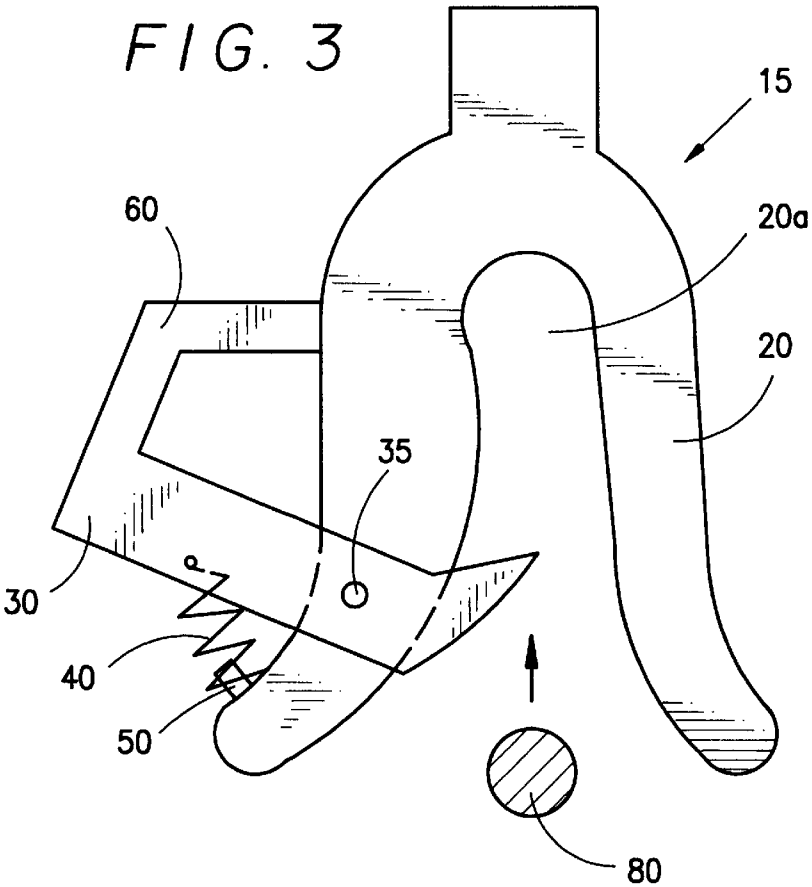
FIG. 3 is a top view of the apparatus with a catch piece in position for movement into the jaw channel.

FIG. 3 is top view schematic of latch 15. Latch 15 comprises a jaw 20, which may be made of steel plate, typically ¾ of an inch thick, although other materials and dimensions may be used. Jaw 20 has channel 20*a* for receiving catch piece 80, as will be further described below. It is understood that different shapes and dimensions of both jaw 20 and channel 20*a* are possible. In this embodiment, channel 20*a* provides generally a larger entry dimension tapering toward a smaller rear dimension, and thus guides catch piece 80 into channel 20*a* and permits some latitude in where catch piece 80 must enter channel 20*a*.

Retainer arm 30 is rotatably connected to jaw 20. Retainer arm 30, in the preferred embodiment, comprises two pieces of connected sheet steel, spaced apart so as to closely sandwich jaw 20. The connection may be by welding, bolting, or other similar means. Typically, a through-bolt 35 connects retainer arm 30 to jaw 20 by insertion through both pieces, and provides the point about which rotation may take place. While many materials and dimensions may be used, each of the connected pieces of retainer arm 30 is usually of ½ inch thick sheet steel. Spring 40 biases retainer arm 30 toward a first closed position. In the first closed position, as in FIG. 3, retainer arm 30 obstructs channel 20*a* of jaw 20 and prevents catch piece 80 from being removed from a rear position in channel 20*a*. A stud 50 provides a means for mounting spring 40 on jaw 20. A handle 60 is attached to retainer arm 30, in the preferred embodiment, for ease in rotating retainer arm 30 to a second open position, thereby providing clearance for catch piece 80 to be removed from channel 20*a*. It is understood that a single piece retainer arm 30 may also be used, bolted so as to be on either the top or bottom of jaw 20.

Apparatus 10 further comprises stand 70, as shown in FIGS. 1 and 2, which may be connected to the rig floor by removable means, such as a hammer union. Horizontal and vertical sections 70*a* and 70*b* of stand 70 may comprise telescoping sections to permit vertical and horizontal position adjustments to latch 15.

Catch piece 80, in the preferred embodiment, is a tubular rod fastened to a tong. Although catch piece 80 is generally attached to a tong such that the longitudinal axis of catch piece 80 runs generally vertically, other angular positions are possible. Catch piece 80 may be of hollow or solid metal, and may be circular or other cross sectional shape.

To use apparatus 10 of the present invention, as shown in FIG. 1, latch 15 is installed on a rig floor by mounting on stand 70. Stand 70 may be adjusted by extending or retracting horizontal and vertical sections 70*a* and 70*b* to position latch 15 where desired, then locking (by set screws or other means well known in the art) horizontal and vertical sections 70*a* and 70*b* in position. Catch piece 80 is mounted on a set of tongs by welding or other means well known in the art.

Figure 4:
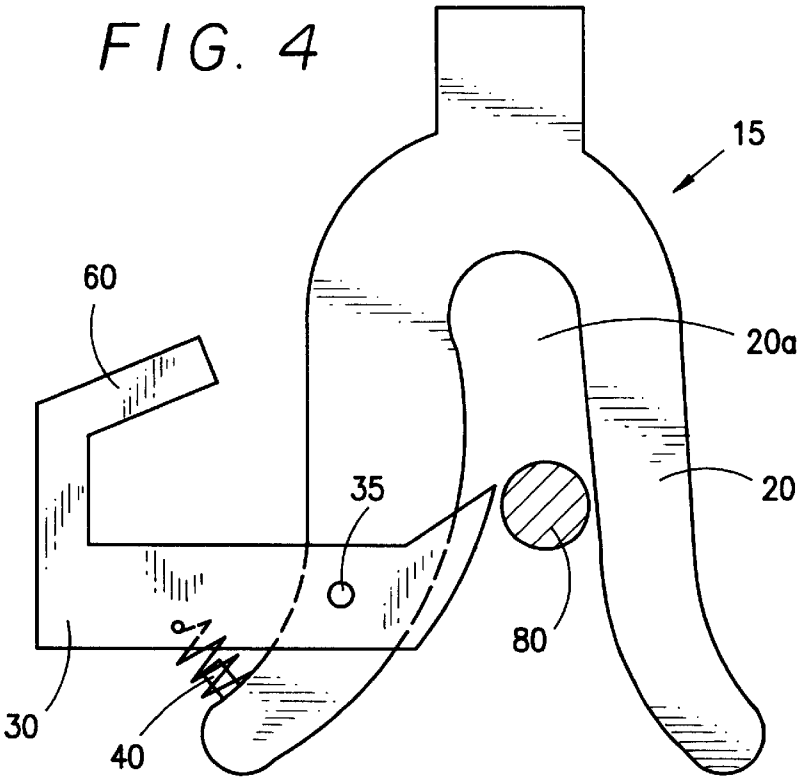
FIG. 4 is a view of the catch piece partially engaged in the latch.
Figure 5:
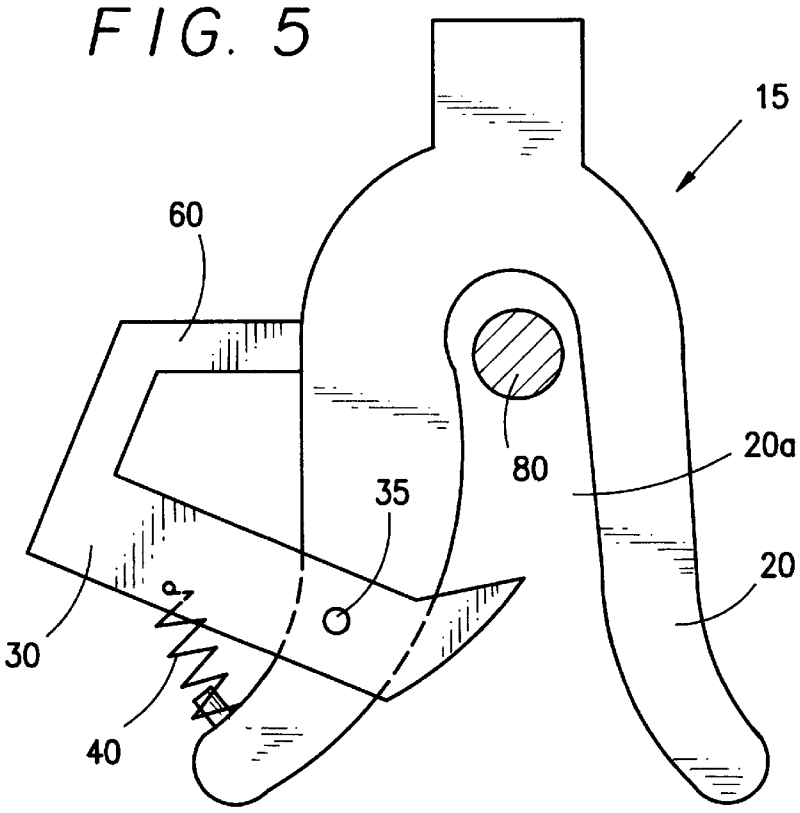
FIG. 5 is a schematic of the catch piece fully engaged in the latch.

When a rig worker desires to secure tongs away from the center of the rig floor, the rig worker guides the drill pipe tongs such that catch piece 80 enters channel 20*a* as shown in FIGS. 2 and 3. Continuing to push the tongs and catch piece 80 toward the terminus of channel 20*a*, catch piece 80 contacts retainer arm 30 and overcomes the bias of spring 40, as shown in FIG. 4. The camming effect of catch piece 80 causes retainer arm 30 to rotate on jaw 20 toward a second open position, and thereby permits passage of catch piece 80 past retainer arm 30, as shown in FIG. 4. Continuing to guide and push the drill pipe tongs and catch piece 80 toward the terminus of channel 20*a*, once catch piece 80 is past the point of last engagement with retainer arm 30, then retainer arm 30 (biased by spring 40) rotates back into the first closed position, trapping catch piece 80 in channel 20*a*, as shown in FIG. 5.

In such manner, it will be seen that catch piece 80 and the tongs to which catch piece 80 are attached are positively held by latch 15 at a desired horizontal displacement away from the center of the rig floor.

Figure 6:
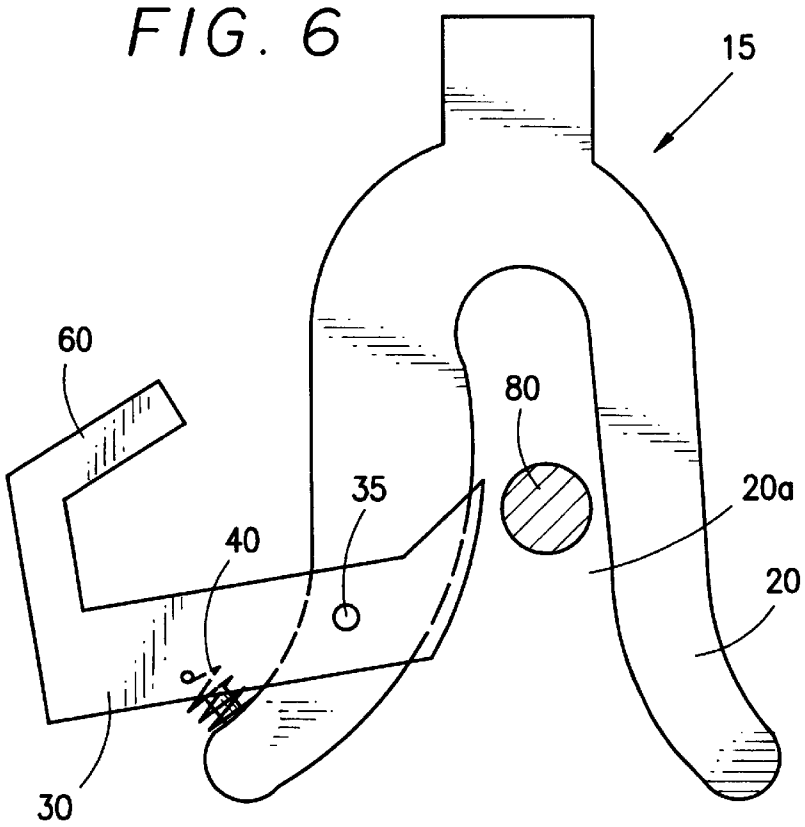
FIG. 6 is a top view with the retainer arm rotated to a second open position providing clearance for removal of the catch piece and tongs.

To release the tongs when needed, handle 60 may be pulled to rotate retainer arm 30 to the second open position as shown in FIG. 6, thereby opening channel 20*a* and permitting catch piece 80 to be moved out of engagement with latch 15.

While the above description provides details regarding a preferred embodiment of the present invention, it is understood that other embodiments may be possible. For example, more than one of the present invention may be mounted on a rig floor to accommodate multiple sets of rig tongs or other equipment. The alignment of jaw 20 and catch piece 80 may be horizontal, vertical, or some angle in between, to accommodate particular set ups of rig equipment and the like. It is also understood that although the description is given in terms of retaining drill pipe tongs, the present invention may be used for other types of rig equipment.

Figure 7:
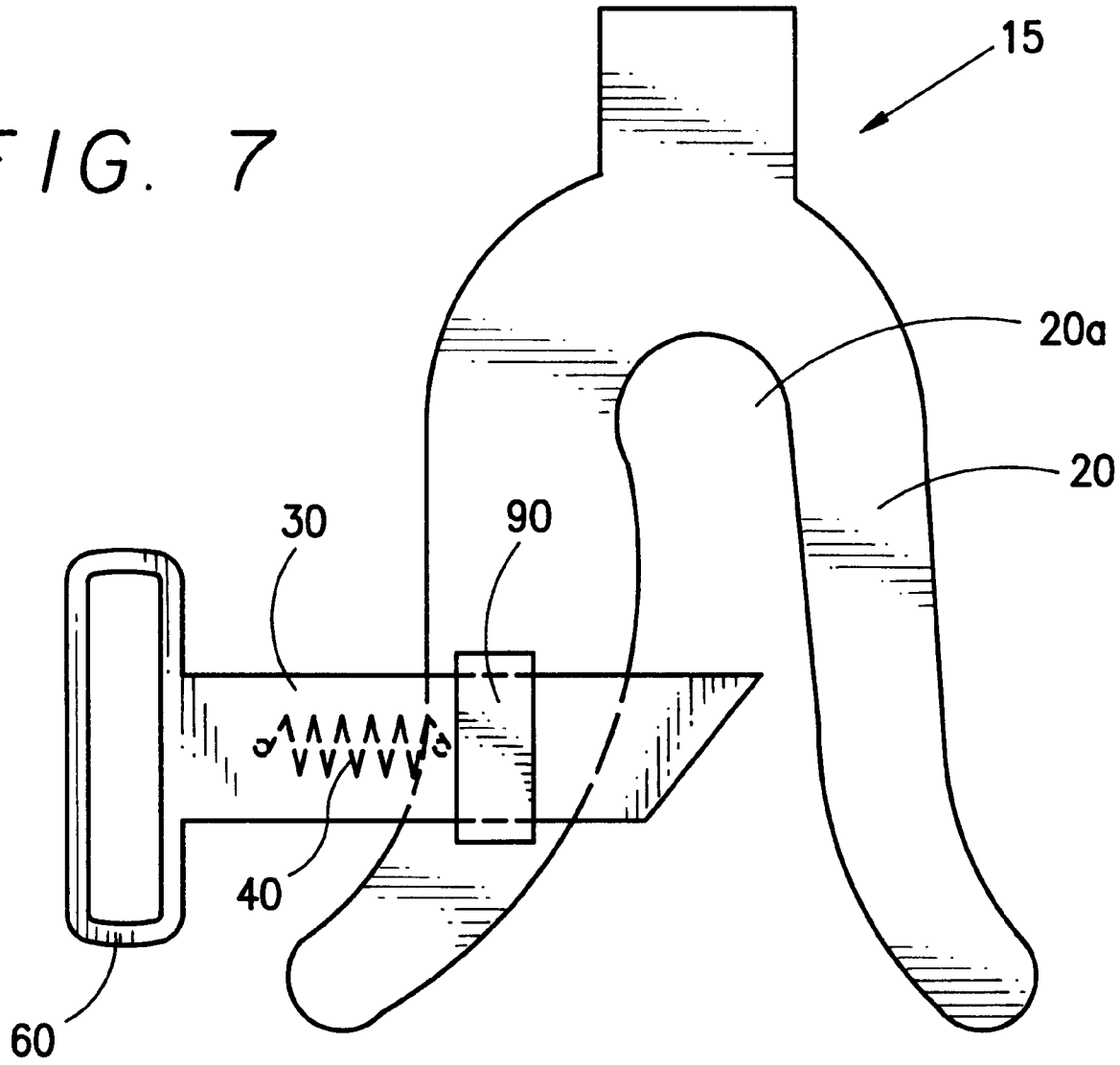
FIG. 7 is a top view of another embodiment of the latch of the present invention.

Yet another embodiment of latch 15 of the present invention comprises a retainer arm that is mounted on jaw 20 so as to move linearly, as shown in FIG. 7, where like parts are numbered consistently with FIGS. 1 through 6. In this embodiment, retainer arm 30 translates between first closed and second open positions through collar 90, under bias of spring 40.

Although the description above contains many specificities, these should not be construed as limiting the scope of the invention but as merely providing illustrations of some of the presently preferred embodiments of this invention. For example, jaw 20, channel 20*a*, and retainer arm 30 may have different shapes.

Thus the scope of the invention should be determined by the appended claims and their legal equivalents, rather than by the examples given.

I claim:

1. An apparatus for retaining drill pipe tongs in a desired position away from the center of a rig floor, comprising:

a) a catch piece mounted on a set of drill pipe tongs;

b) a latch for engaging and releasably holding said catch piece; and c) means for mounting said latch at a desired position with respect to a rig floor.

2. The apparatus of claim 1, wherein said latch comprises a jaw having a channel therein and retainer arm mounted on said jaw and movable between a first closed position and a second open position across said channel, said retainer arm movable by cam action out of said first closed position to said second open position by passage of said catch piece along said channel, said retainer arm spring biased back into said first closed position upon complete passage of said catch piece, thereby releasably trapping said catch piece in said channel.

3. The apparatus of claim 2, wherein said retainer arm is rotatably mounted on said jaw and rotates between said first open position and said second closed position.

4. The apparatus of claim 1, wherein said retainer arm is mounted on said jaw so as to move linearly between said first closed position and said second open position.

5. The apparatus of claim 1, wherein said means for mounting comprises an inverted L-shaped stand having a vertical section removably attached to said rig floor and a horizontal section attached substantially perpendicularly to said vertical section, said latch connected to said horizontal section.

6. The apparatus of claim 5, wherein each of said vertical and horizontal sections of said stand comprise telescoping sections.

7. An apparatus for positively retaining drill pipe tongs at a desired position horizontally displaced from a center of a rig floor, comprising:

a) an inverted L-shaped stand having a vertical section releasably mounted to a rig floor and a horizontal section attached substantially perpendicularly to said vertical member;

b) a latch connected to said horizontal section; and c) a catch piece attached to a set of drill pipe tongs, said catch piece for gripping in said latch, thereby releasably holding said drill pipe tongs.

8. The apparatus of claim 7, wherein said latch comprises a jaw having a tapering channel therein for receiving said catch piece, and a retainer arm rotatably mounted on said jaw and rotatably movable between a first closed position wherein said retainer arm blocks said channel and a second open position wherein said retainer arm clears said channel, said retainer arm spring biased toward said first closed position, passage of said catch piece along said channel displacing said retainer arm from said first closed position to said second open position, permitting said catch piece to move to a terminus of said channel.

9. The apparatus of claim 8, wherein said catch piece comprises an elongated tubular member.

10. The apparatus of claim 9, wherein said vertical and said horizontal sections of said stand comprise telescoping pieces, whereby a height of said latch above said rig floor and said horizontal displacement of said latch from said center of said rig floor may be varied.

11. A method of positively retaining drill pipe tongs at a desired position away from the center of a rig floor, comprising the steps of:

a) providing an apparatus comprising:

an inverted L-shaped stand having a vertical section releasably mounted to a rig floor and a horizontal section attached substantially perpendicularly to said vertical member;

a catch piece attached to a set of drill pipe tongs;

a latch connected to said horizontal section of said stand, said latch comprising a jaw having a tapering channel therein for receiving said catch piece, and a retainer arm mounted on said jaw and movable between a first closed position wherein said retainer arm blocks said channel and a second open position wherein said retainer arm clears said channel, said retainer arm spring biased toward said first closed position; and b) guiding a set of tongs so that said catch piece traverses said channel along its length to its terminus, said catch piece camming said retainer arm from said first closed position to said second open position then moving out of contact with said retainer arm, said retainer arm then free to return to said first closed position, releasably trapping said catch piece in said channel.

* * * * *